US010151287B2

(12) United States Patent
Wang et al.

(10) Patent No.: US 10,151,287 B2
(45) Date of Patent: Dec. 11, 2018

(54) SELF-LOCKING INTERNAL DAMPER AND FUEL RAIL ASSEMBLY

(71) Applicant: Continental Automotive GmbH, Hannover (DE)

(72) Inventors: Liang Wang, Changchun (CN); Jingying Liu, Changchun (CN); Kang Wang, Changchun (CN); Jinpeng Xu, Changchun (CN); Guangchun Ll, Changchun (CN); Guiyang Wu, Changchun (CN); Yanxin Sun, Changchun (CN); Ming Yang, Changchun (CN)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 19 days.

(21) Appl. No.: 15/503,469

(22) PCT Filed: Aug. 3, 2015

(86) PCT No.: PCT/EP2015/067780
§ 371 (c)(1),
(2) Date: Feb. 13, 2017

(87) PCT Pub. No.: WO2016/023777
PCT Pub. Date: Feb. 18, 2016

(65) Prior Publication Data

US 2017/0234282 A1 Aug. 17, 2017

(30) Foreign Application Priority Data

Aug. 13, 2014 (CN) ..... 2014 2 0457082 U

(51) Int. Cl.
*F02M 55/00* (2006.01)
*F02M 55/04* (2006.01)
(Continued)

(52) U.S. Cl.
CPC ..... *F02M 55/04* (2013.01); *F02M 55/025* (2013.01); *F02M 69/465* (2013.01); *F02M 2200/09* (2013.01); *F02M 2200/315* (2013.01)

(58) Field of Classification Search
CPC ..... F02M 55/04; F02M 2200/315
See application file for complete search history.

(56) References Cited

U.S. PATENT DOCUMENTS 6,463,911 B1 * 10/2002 Treusch ..... F02M 55/04 123/456
2001/0042538 A1 * 11/2001 Rossi ..... F02M 55/04 123/456
(Continued)

FOREIGN PATENT DOCUMENTS

CN 203022940 U 6/2013 ..... F02M 55/02
EP 2902615 A1 8/2015 ..... F02M 55/02
(Continued)

OTHER PUBLICATIONS

International Search Report and Written Opinion, Application No. PCT/EP2015/067780, 11 pages, dated Oct. 30, 2015.

*Primary Examiner* — Hieu T Vo
*Assistant Examiner* — Sherman Manley
(74) *Attorney, Agent, or Firm* — Slayden Grubert Beard PLLC

(57) ABSTRACT

The present disclosure relates to the field of motor vehicles. The teachings thereof may be embodied in a self-locking internal damper comprising: a damper body with a closed chamber; each of two ends of the closed chamber in the length direction including a straight plate section projecting therefrom, with a center line of the straight plate section passing through a center point of the closed chamber; two connecting portions located at ends of the two straight plate sections, respectively; and at least one of the two connecting
(Continued)

portions including a bent structure formed by extending and bending one of the straight plate sections.

18 Claims, 6 Drawing Sheets

(51) Int. Cl.
*F02M 55/02* (2006.01)
*F02M 69/46* (2006.01)

(56) References Cited

U.S. PATENT DOCUMENTS

| | | | | |
|---|---|---|---|---|
| 2003/0084879 | A1* | 5/2003 | Treusch | F02M 55/04 123/456 |
| 2005/0126540 | A1* | 6/2005 | Braun | F02M 55/04 123/456 |
| 2015/0240767 | A1 | 8/2015 | Wang et al. | 239/585.1 |

FOREIGN PATENT DOCUMENTS

| | | | | |
|---|---|---|---|---|
| JP | 2000320422 | A | 11/2000 | F02M 55/02 |
| JP | 2001207934 | A | 8/2001 | F02M 37/00 |
| WO | 2016/023777 | A1 | 2/1916 | F02M 55/02 |
| WO | 2014/030056 | A1 | 2/2014 | F02M 55/02 |
| WO | WO 2014030056 | A1 * | 2/2014 | F02M 55/025 |

* cited by examiner

SELF-LOCKING INTERNAL DAMPER AND FUEL RAIL ASSEMBLY

CROSS-REFERENCE TO RELATED APPLICATIONS

This application is a U.S. National Stage Application of International Application No. PCT/EP2015/067780 filed Aug. 3, 2015, which designates the United States of America, and claims priority to CN Application No. 201420457082.8 filed Aug. 13, 2014, the contents of which are hereby incorporated by reference in their entirety.

TECHNICAL FIELD

The present disclosure relates to the field of motor vehicles. The teachings thereof may be embodied in a self-locking internal damper and a fuel rail assembly incorporating such a damper.

BACKGROUND

A fuel rail assembly distributes fuel to fuel injectors by a fuel rail, and then injects the fuel by the fuel injectors into the air intake passage of an engine. The fuel injectors are controlled by fuel injection command signals issued by the engine's ECU (Electronic Control Unit). During injection by a fuel injector, the amount of fuel in the fuel rail is reduced, and the pressure is reduced, causing a pressure fluctuation inside the fuel rail. Pressure fluctuation causes vibration and noise in the fuel rail and has an impact on the injection effect of the fuel injectors. To achieve a good injection effect, the pressure inside the fuel rail must be kept constant. A damper is an apparatus for maintaining pressure inside a fuel rail. Existing dampers in fuel rail assemblies have the following shortcomings:

(1) they require a larger space for installation;
(2) they have a complex structure;
(3) they have a high cost.

SUMMARY

The present disclosure may be embodied in various self-locking internal dampers with a simple structure and a good fuel pressure stabilizing effect, and/or fuel rail assemblies having such a damper. Some embodiments may include a self-locking internal damper, characterized by comprising: a damper body (10) having a closed chamber, each of two ends of the chamber in the length direction thereof having a straight plate section (20) projecting therefrom, with a center line of the straight plate section (20) passing through a center point of the chamber; two connecting portions (30) located at ends of the two straight plate sections (20), respectively, at least one of the two connecting portions (30) being a bent structure formed by extending and bending the straight plate section (20).

In some embodiments, the two straight plate sections (20) and a center plane of the chamber in the length direction thereof are located in the same plane.

In some embodiments, the two connecting portions (30) are symmetrically disposed at two ends of the damper body (10).

In some embodiments, the two straight plate sections (20) are symmetrically disposed at two ends of the damper body (10).

In some embodiments, at least one of the straight plate sections (20) is rectangular.

In some embodiments, one of the straight plate sections (20) is rectangular, while at least part of the other straight plate section (20) is trapezoidal, and the width of the trapezoidal straight plate section (20) decreases progressively in the direction from the chamber to the connecting portion (30).

In some embodiments, at least part of at least one of the straight plate sections (20) is trapezoidal.

In some embodiments, at least one of the connecting portions (30) with a bent structure comprises: a first connecting portion (31), one end of the first connecting portion (31) being connected to one of the straight plate sections (20), another end of the first connecting portion (31) extending in a direction away from one of the straight plate sections (20), with an included angle between the first connecting portion (31) and one of the straight plate sections (20); a second connecting portion (32), one end of the second connecting portion (32) being connected to the other end of the first connecting portion (31), another end of the second connecting portion (32) extending in a direction away from the first connecting portion (31), with an included angle between the first connecting portion (31) and the second connecting portion (32); a third connecting portion (33), one end of the third connecting portion (33) being connected to the other end of the second connecting portion (32), another end of the third connecting portion (33) extending in a direction away from the second connecting portion (32), with an included angle between the second connecting portion (32) and the third connecting portion (33); wherein the first connecting portion (31), the second connecting portion (32) and the third connecting portion (33) together form the bent structure.

In some embodiments, the two connecting portions (30) are both bent structures.

In some embodiments, the two connecting portions (30) have the same structure, wherein the size of one of the connecting portions (30) is larger than the size of the other connecting portion (30).

In some embodiments, the two bent structures are symmetrically disposed at two ends of the damper body (10).

In some embodiments, the other connecting portion (30) with the bent structure has one end connected to the other straight plate section (20) and another end extending in a curved manner in a direction away from the other straight plate section (20).

In some embodiments, the two connecting portions (30) are both bent structures, and the other connecting portion (30) with a bent structure comprises: a fourth connecting portion (37), one end of the fourth connecting portion (37) being connected to the other straight plate section (20), another end of the fourth connecting portion (37) extending in a direction away from the other straight plate section (20), with an included angle between the fourth connecting portion (37) and the other straight plate section (20); a fifth connecting portion (38), one end of the fifth connecting portion (38) being connected to the other end of the fourth connecting portion (37), another end of the fifth connecting portion (38) extending in a direction away from the fourth connecting portion (37), with an included angle between the fourth connecting portion (37) and the fifth connecting portion (38); a sixth connecting portion (39), one end of the sixth connecting portion (39) being connected to the other end of the fifth connecting portion (38), another end of the sixth connecting portion (39) extending in a direction away from the fifth connecting portion (38), with an included angle between the fifth connecting portion (38) and the sixth connecting portion (39); wherein the fourth connecting portion (37), the fifth connecting portion (38) and the sixth connecting portion (39) together form the bent structure; the length of the fourth connecting portion (37) is longer than the length of the sixth connecting portion (39), the length of the fourth connecting portion (37) is longer than the length of the first connecting portion (31), the length of the fifth connecting portion (38) is longer than the length of the second connecting portion (32), and the length of the sixth connecting portion (39) is longer than the length of the third connecting portion (33).

In some embodiments, the connecting portion (30) further comprises: a seventh connecting portion (34), which has one end connected to the third connecting portion (33) and another end as a free end, the seventh connecting portion (34) and the straight plate section (20) being in the same plane.

Some embodiments may include a fuel rail assembly, comprising a main fuel pipe (40), and a first end cover (41) and a second end cover (42) which are disposed at two ends of the main fuel pipe (40), respectively, characterized in that the self-locking internal damper as claimed in any one of claims 1 to 14 is disposed in the main fuel pipe (40), wherein at least one of the connecting portions (30) is fixed in the first end cover (41) or second end cover (42).

In some embodiments, an opening of the first end cover (41) and an opening of the second end cover (42) are disposed facing each other.

In some embodiments, an opening of the first end cover (41) faces the interior of the chamber, while an opening of the second end cover (42) faces away from the interior of the chamber.

In some embodiments, the cross section of the main fuel pipe (40) is round, and a center line of the chamber coincides with the axis of the main fuel pipe (40).

In some embodiments, the cross section of the main fuel pipe (40) is square, and the plane in which the straight plate section (20) is located coincides with the plane in which a diagonal of the main fuel pipe (40) along the length direction thereof is located.

BRIEF DESCRIPTION OF THE DRAWINGS

The drawings show one or more schematic embodiments of the teachings of the present disclosure. The explanations thereof provide detail, but not limitation thereof. In the drawings.

DETAILED DESCRIPTION

Figure 1:
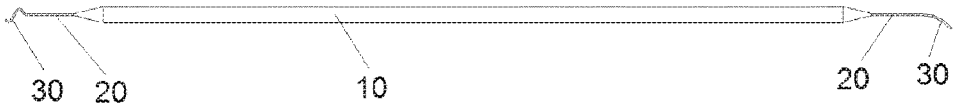
FIG. 1 shows a main view of a self-locking internal damper, according to teachings of the present disclosure.
Figure 2:
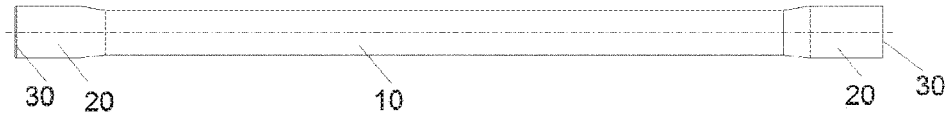
FIG. 2 shows a view of FIG. 1 from above.
Figure 3:
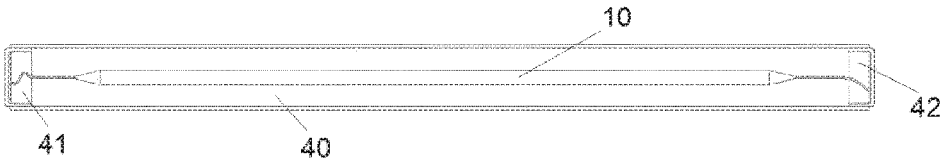
FIG. 3 shows a main view of a self-locking internal damper and fuel rail assembly in an assembled state, according to teachings of the present disclosure.
Figure 4:
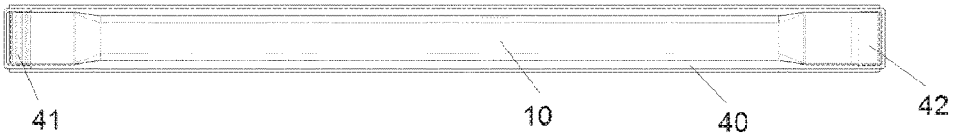
FIG. 4 shows a view of FIG. 3 from above.

In some embodiments, a self-locking internal damper may include: a damper body having a closed chamber, each of two ends of the chamber in the length direction thereof having a straight plate section projecting therefrom, with a center line of the straight plate section passing through a center point of the chamber; two connecting portions located at ends of the two straight plate sections, respectively, at least one of the two connecting portions being a bent structure formed by extending and bending the straight plate section.

In some embodiments, the two straight plate sections and a center plane of the chamber in the length direction thereof are located in the same plane.

In some embodiments, the two connecting portions are symmetrically disposed at two ends of the damper body.

In some embodiments, the two straight plate sections are symmetrically disposed at two ends of the damper body.

In some embodiments, at least one straight plate section is rectangular.

In some embodiments, one straight plate section is rectangular, while at least part of the other straight plate section is trapezoidal, and the width of the trapezoidal straight plate section decreases progressively in the direction from the chamber to the connecting portion.

In some embodiments, at least part of at least one straight plate section is trapezoidal.

In some embodiments, at least one connecting portion with a bent structure comprises: a first connecting portion, one end of the first connecting portion being connected to a straight plate section, another end of the first connecting portion extending in a direction away from a straight plate section, with an included angle between the first connecting portion and a straight plate section; a second connecting portion, one end of the second connecting portion being connected to the other end of the first connecting portion, another end of the second connecting portion extending in a direction away from the first connecting portion, with an included angle between the first connecting portion and the second connecting portion; a third connecting portion, one end of the third connecting portion being connected to the other end of the second connecting portion, another end of the third connecting portion extending in a direction away from the second connecting portion, with an included angle between the second connecting portion and the third connecting portion; wherein the first connecting portion, second connecting portion and third connecting portion together form a bent structure.

In some embodiments, the two connecting portions are both bent structures.

In some embodiments, the two connecting portions have the same structure, wherein the size of one connecting portion is larger than the size of the other connecting portion.

In some embodiments, two bent structures are symmetrically disposed at two ends of the damper body.

In some embodiments, another connecting portion with a bent structure has one end connected to another straight plate section and another end extending in a curved manner in a direction away from the other straight plate section.

In some embodiments, the two connecting portions are both bent structures, and the other connecting portion with a bent structure comprises: a fourth connecting portion, one end of the fourth connecting portion being connected to another straight plate section, another end of the fourth connecting portion extending in a direction away from the other straight plate section, with an included angle between the fourth connecting portion and the other straight plate section; a fifth connecting portion, one end of the fifth connecting portion being connected to the other end of the fourth connecting portion, another end of the fifth connecting portion extending in a direction away from the fourth connecting portion, with an included angle between the fourth connecting portion and the fifth connecting portion; a sixth connecting portion, one end of the sixth connecting portion being connected to the other end of the fifth connecting portion, another end of the sixth connecting portion extending in a direction away from the fifth connecting portion, with an included angle between the fifth connecting portion and the sixth connecting portion; wherein the fourth connecting portion, fifth connecting portion and sixth connecting portion together form a bent structure; the length of the fourth connecting portion is longer than the length of the sixth connecting portion, the length of the fourth connecting portion is longer than the length of the first connecting portion, the length of the fifth connecting portion is longer than the length of the second connecting portion, and the length of the sixth connecting portion is longer than the length of the third connecting portion.

In some embodiments, the connecting portion further comprises: a seventh connecting portion, which has one end connected to the third connecting portion and another end as a free end, the seventh connecting portion and straight plate section being in the same plane.

Some embodiments may include a fuel rail assembly is also provided, comprising a main fuel pipe, and a first end cover and a second end cover which are disposed at two ends of the main fuel pipe, respectively, with the self-locking internal damper as claimed in any one of claims 1 to 14 being disposed in the main fuel pipe, wherein at least one connecting portion is fixed in the first end cover or second end cover.

In some embodiments, an opening of the first end cover and an opening of the second end cover are disposed facing each other.

In some embodiments, an opening of the first end cover faces the interior of the chamber, while an opening of the second end cover faces away from the interior of the chamber.

Furthermore, the cross section of the main fuel pipe is round, and a center line of the chamber coincides with the axis of the main fuel pipe.

In some embodiments, the cross section of the main fuel pipe is square, and the plane in which the straight plate section is located coincides with the plane in which a diagonal of the main fuel pipe along the length direction thereof is located.

In some embodiments, the self-locking internal damper comprises a damper body, straight plate sections and two connecting portions. The damper body has a closed chamber, each of two ends of the chamber in the length direction thereof having a straight plate section projecting therefrom, with a center line of the straight plate section passing through a center point of the chamber. Two connecting portions are located at ends of the two straight plate sections, respectively, at least one of the two connecting portions being a bent structure formed by extending and bending the straight plate section. The damper body has a closed chamber, each of two ends of the chamber in the length direction thereof has a straight plate section projecting therefrom, connecting portions with bent structures are further provided at the ends of the straight plate sections, the connecting portions with bent structures facilitating installation of the entire self-locking internal damper in another apparatus; therefore the structure is simple, and the fuel pressure stabilizing effect is good. The self-locking internal damper of the present utility model has a simple structure and a good fuel pressure stabilizing effect.

The various embodiments of the teachings and features in the embodiments may be combined, as long as this does not give rise to conflict. As shown in FIGS. 1 to 16, the teachings of the present disclosure may be embodied in self-locking internal dampers.

Specifically, as the embodiments of FIGS. 1, 5, 9 and 13 show, a self-locking internal damper comprises a damper body 10, straight plate sections 20, and two connecting portions 30. The damper body 10 has a closed chamber to stabilize fuel pressure effectively. Each of two ends of the chamber in the length direction thereof has a straight plate section 20 projecting therefrom; the two straight plate sections 20 are located on the length direction of the chamber, and a center line of each straight plate section 20 passes through a center point of the chamber, so that the structure is simple to manufacture. The two connecting portions 30 are located at ends of the two straight plate sections 20, respectively. Two of the entire self-locking internal damper each has one connecting portion 30. The purpose of the connecting portions 30 is to enable the self-locking internal damper to be installed on another apparatus, e.g., to enable the self-locking internal damper to be installed in a fuel rail assembly. At least one of the two connecting portions 30 may be a bent structure formed by extending and bending the straight plate section. The connecting portion with a bent structure enables the self-locking internal damper to be connected to the fuel rail assembly more stably and firmly.

The damper body 10 has a closed chamber, each of two ends of the chamber in the length direction thereof has a straight plate section 20 projecting therefrom, connecting portions 30 are further provided at the ends of the straight plate sections 20, the connecting portions 30 facilitating installation of the entire self-locking internal damper in another apparatus, and the connecting portion with a bent structure enables the self-locking internal damper to be in the fuel rail assembly more stably and firmly. Therefore the structure is simple, processing and manufacturing are easy, product costs may be reduced, and the fuel pressure stabilizing effect may be improved.

The self-locking internal damper of the present disclosure has a simple structure and a good fuel pressure stabilizing effect. The two straight plate sections 20 and a center plane of the chamber in the length direction thereof may be located in the same plane; the entire apparatus is arranged symmetrically, so the structure is stable and manufacturing is convenient.

As shown in the embodiments of FIGS. 1, 5, 8, and 13, at least one of the two connecting portions 30 is a bent structure formed by extending and bending the straight plate section 20. The bent structure may be wave-shaped and S-shaped, to facilitate connection of the self-locking internal damper to another apparatus, so that the self-locking internal damper will not easily loosen and detach from the other apparatus.

Figure 5:
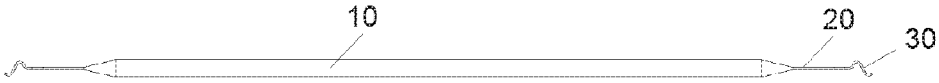
FIG. 5 shows a main view of a self-locking internal damper, according to teachings of the present disclosure.
Figure 6:
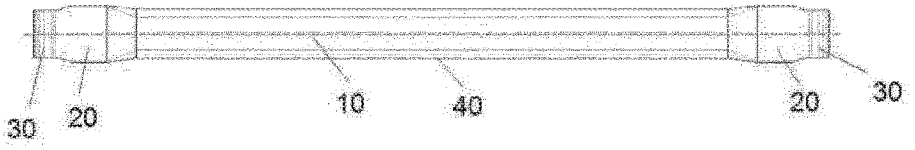
FIG. 6 shows a view of FIG. 5 from above.
Figure 7:
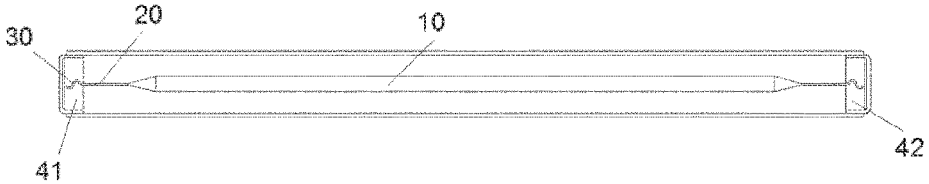
FIG. 7 shows a main view of a self-locking internal damper and fuel rail assembly in an assembled state, according to teachings of the present disclosure.
Figure 8:
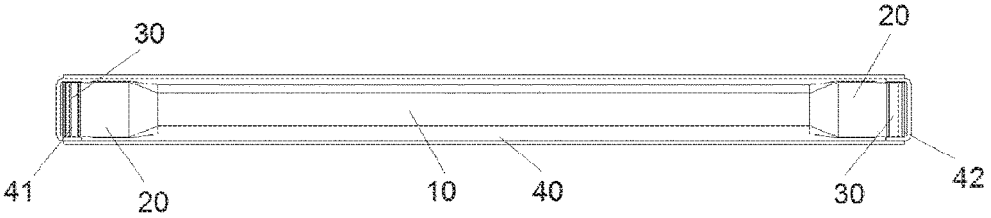
FIG. 8 shows a view of FIG. 7 from above.

As shown in the embodiments of FIGS. 1, 9, 10, and 13, the two connecting portions 30 are disposed asymmetrically at the two ends of the damper body 10. Of course, as FIGS. 5 and 6 show, the two connecting portions 30 may also be disposed symmetrically at the two ends of the damper body 10.

Figure 12:
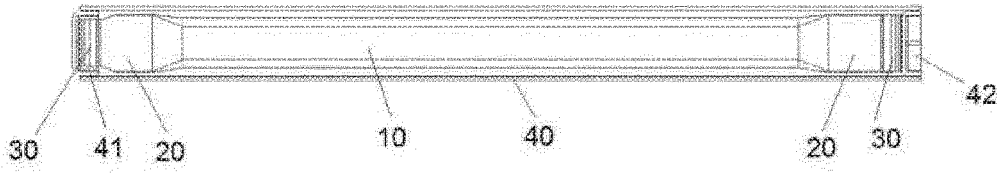
FIG. 12 shows a view of FIG. 11 from above.

As the embodiments of FIGS. 2, 4, 6, 8, 14, and 16 show, the two straight plate sections 20 may be disposed symmetrically at the two ends of the damper body 10. Of course, as FIGS. 10 and 12 show, the two straight plate sections 20 may also be disposed asymmetrically at the two ends of the damper body 10.

Figure 10:
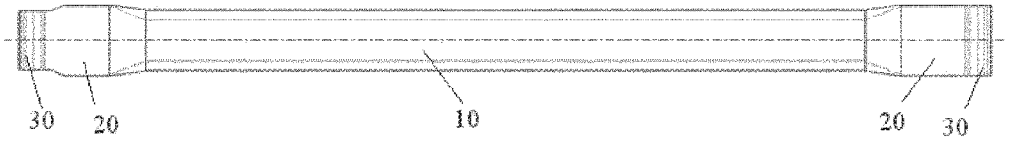
FIG. 10 shows a view of FIG. 9 from above.
Figure 11:
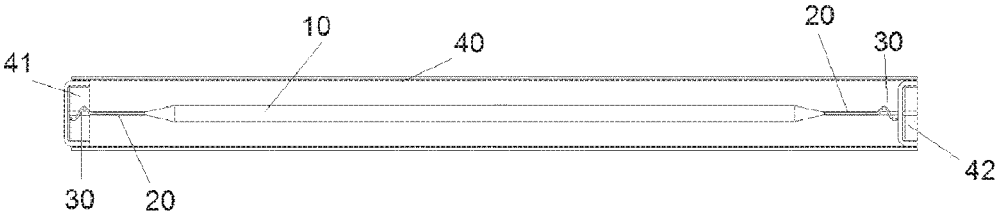
FIG. 11 shows a main view of a self-locking internal damper and fuel rail assembly in an assembled state, according to teachings of the present disclosure.

As FIG. 10 shows, at least one straight plate section 20 may be rectangular.

As FIGS. 2, 4, 14 and 16 show, the two straight plate sections 20 may be both rectangular.

As FIGS. 6 and 10 show, at least part of at least one straight plate section 20 may be trapezoidal.

As FIG. 10 shows, one straight plate section 20 may be rectangular, while at least part of the other straight plate section 20 may be trapezoidal, and the width of the trapezoidal straight plate section 20 may decrease progressively in the direction from the chamber to the connecting portion 30.

The trapezoidal straight plate section 20 may be formed by cutting from two side edges in the width direction of the trapezoidal straight plate section 20. The trapezoidal straight plate section 20 may be easily insert-connected to another apparatus, such as an end cover of a fuel rail assembly, so that the self-locking internal damper will not easily loosen and detach from the other apparatus such as a fuel rail assembly.

As shown in the embodiments of FIGS. 1, 5, 9, 13 and 19, at least one of the two connecting portions 30 may be a bent structure. The connecting portion 30 with the bent structure comprises a first connecting portion 31, a second connecting portion 32, and a third connecting portion 33.

One end of the first connecting portion 31 may be connected to a straight plate section 20, while another end of the first connecting portion 31 may extend in a direction away from a straight plate section 20, with an included angle between the first connecting portion 31 and a straight plate section 20. One end of the second connecting portion 32 may be connected to the other end of the first connecting portion 31, while another end of the second connecting portion 32 extends in a direction away from the first connecting portion 31, with an included angle between the first connecting portion 31 and the second connecting portion 32. One end of the third connecting portion 33 may be connected to the other end of the second connecting portion 32, while another end of the third connecting portion 33 extends in a direction away from the second connecting portion 32, with an included angle between the second connecting portion 32 and the third connecting portion 33. The first connecting portion 31, second connecting portion 32, and third connecting portion 33 together form a bent structure.

As shown in the embodiments of FIGS. 5, 9, 13, 19, and 20, the two connecting portions 30 may be both bent structures.

Figure 13:
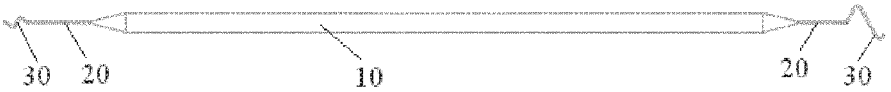
FIG. 13 shows a main view of a self-locking internal damper, according to teachings of the present disclosure.
Figure 14:
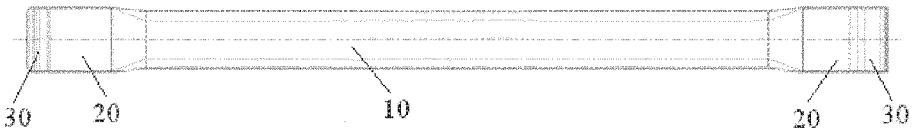
FIG. 14 shows a view of FIG. 13 from above.
Figure 15:
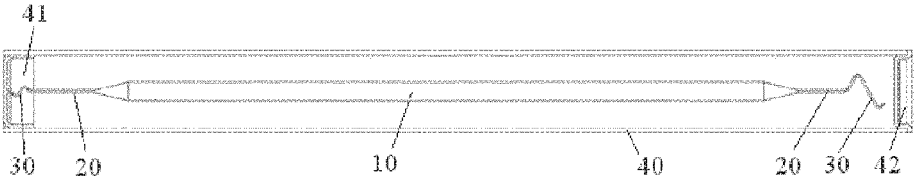
FIG. 15 shows a main view of a self-locking internal damper and fuel rail assembly in an assembled state, according to teachings of the present disclosure.
Figure 16:
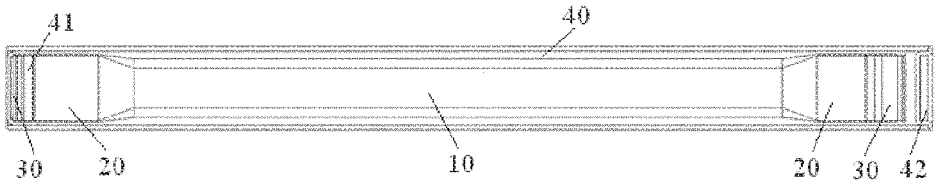
FIG. 16 shows a view of FIG. 15 from above.

Furthermore, as FIG. 13 shows, the two connecting portions 30 may have the same structure, wherein the size of one connecting portion 30 is larger than the size of the other connecting portion 30. For example, one bent structure may be as in the above description; the other connecting portion 30 with a bent structure comprises a fourth connecting portion 37, a fifth connecting portion 38, and a sixth connecting portion 39. One end of the fourth connecting portion 37 may be connected to another straight plate section 20, another end of the fourth connecting portion 37 may extend in a direction away from the other straight plate section 20, with an included angle between the fourth connecting portion 37 and the other straight plate section 20; the fifth connecting portion 38: one end of the fifth connecting portion 38 may be connected to the other end of the fourth connecting portion 37, another end of the fifth connecting portion 38 extends in a direction away from the fourth connecting portion 37, with an included angle between the fourth connecting portion 37 and the fifth connecting portion 38; the sixth connecting portion 39: one end of the sixth connecting portion 39 may be connected to the other end of the fifth connecting portion 38, another end of the sixth connecting portion 39 extends in a direction away from the fifth connecting portion 38, with an included angle between the fifth connecting portion 38 and the sixth connecting portion 39. The fourth connecting portion 37, fifth connecting portion 38, and sixth connecting portion 39 together form a bent structure; the length of the fourth connecting portion 37 is longer than the length of the sixth connecting portion 39, the length of the fourth connecting portion 37 may be longer than the length of the first connecting portion 31, the length of the fifth connecting portion 38 may be longer than the length of the second connecting portion 32, and the length of the sixth connecting portion 39 may be longer than the length of the third connecting portion 33.

In some embodiments, two bent structures are symmetrically disposed at two ends of the damper body 10. As FIG. 1 shows, another connecting portion 30 with a bent structure may have one end connected to another straight plate section 20 and another end extending in a curved manner in a direction away from the other straight plate section 20, e.g., extending towards a region below the other straight plate section 20.

In the embodiment shown in FIG. 1: one connecting portion 30 is a bent structure, another connecting portion 30 has one end connected to a straight plate section 20 and another end extending in a curved manner in a direction away from the straight plate section 20, e.g., extending towards a region below the other straight plate section 20.

Figure 19:
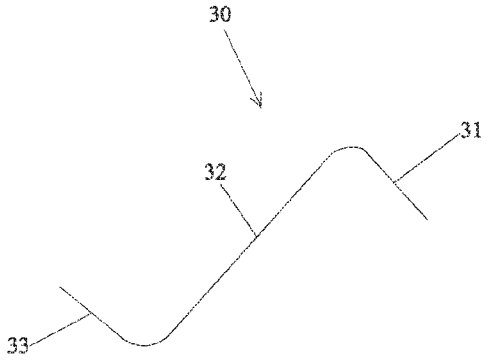
FIG. 19 shows a schematic diagram of the entire structure of a connecting portion, according to teachings of the present disclosure.

In the embodiment as shown in FIG. 5: two connecting portions 30 with bent structures are symmetrically disposed at two ends of the damper body 10, the specific structures of the two connecting portions 30 with bent structures being shown in FIG. 19. The connecting portion 30 with the bent structure comprises a first connecting portion 31, a second connecting portion 32 and a third connecting portion 33. One end of the first connecting portion 31 is connected to a straight plate section 20, another end of the first connecting portion 31 extends in a direction away from a straight plate section 20, with an included angle between the first connecting portion 31 and a straight plate section 20. One end of the second connecting portion 32 is connected to the other end of the first connecting portion 31, another end of the second connecting portion 32 extends in a direction away from the first connecting portion 31, with an included angle between the first connecting portion 31 and the second connecting portion 32. One end of the third connecting portion 33 is connected to the other end of the second connecting portion 32, another end of the third connecting portion 33 extends in a direction away from the second connecting portion 32, with an included angle between the second connecting portion 32 and the third connecting portion 33. The first connecting portion 31, second connecting portion 32 and third connecting portion 33 together form a bent structure.

Figure 9:
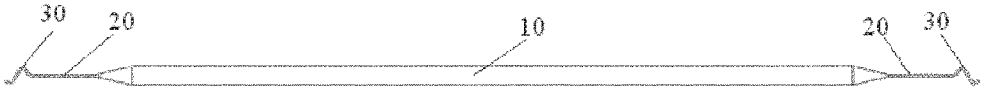
FIG. 9 shows a main view of a self-locking internal damper, according to teachings of the present disclosure.

In the embodiment as shown in FIG. 9: the two bent structures are the same as in the second embodiment, but the structure of the straight plate section 20 in the third embodiment is different from the structure of the straight plate section 20 in the second embodiment.

Figure 20:
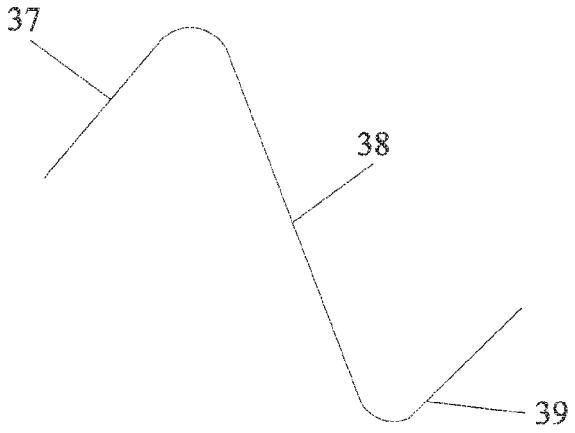
FIG. 20 shows a schematic diagram of the entire structure of another connecting portion, according to teachings of the present disclosure.
Figure 21:
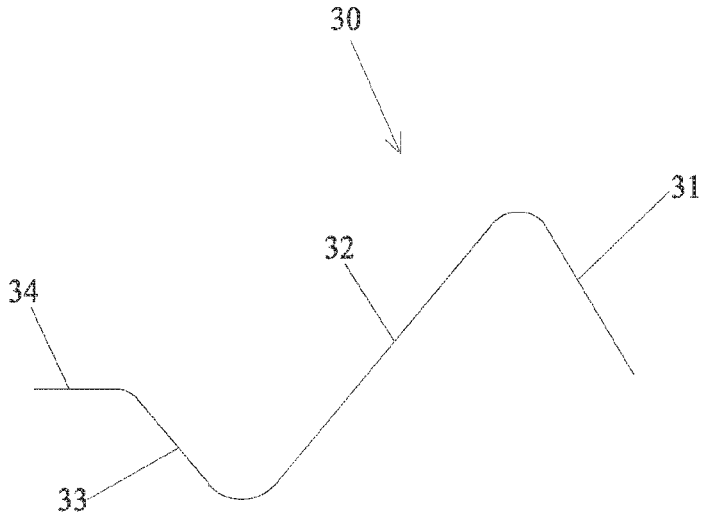
FIG. 21 shows a schematic diagram of the entire structure of another connecting portion, according to teachings of the present disclosure.

In the embodiment as shown in FIG. 13: the structure of one connecting portion 30 with a bent structure is as shown in FIG. 21; this connecting portion 30 with a bent structure comprises a first connecting portion 31, a second connecting portion 32, a third connecting portion 33 and a seventh connecting portion 34. One end of the first connecting portion 31 is connected to a straight plate section 20, another end of the first connecting portion 31 extends in a direction away from a straight plate section 20, with an included angle between the first connecting portion 31 and a straight plate section 20. One end of the second connecting portion 32 is connected to the other end of the first connecting portion 31, another end of the second connecting portion 32 extends in a direction away from the first connecting portion 31, with an included angle between the first connecting portion 31 and the second connecting portion 32. One end of the third connecting portion 33 is connected to the other end of the second connecting portion 32, another end of the third connecting portion 33 extends in a direction away from the second connecting portion 32, with an included angle between the second connecting portion 32 and the third connecting portion 33. The first connecting portion 31, second connecting portion 32 and third connecting portion 33 together form a bent structure. Furthermore, the connecting portion 30 also comprises a seventh connecting portion 34, which has one end connected to the third connecting portion 33 and another end as a free end, the seventh connecting portion 34 and straight plate section 20 being in the same plane. Thus, the first connecting portion 31, second connecting portion 32, third connecting portion 33 and seventh connecting portion 34 together form a bent structure. The seventh connecting portion 34 and straight plate section 20 are in the same plane, and there are chamfers on two sides of the free end of the seventh connecting portion 34; such a design allows the seventh connecting portion 34 to be inserted into another device more smoothly. The other connecting portion 30 with a bent structure is as shown in FIG. 20; part of the structure of the connecting portion 30 with a bent structure in FIG. 20 is the same as part of the structure of the connecting portion 30 in FIG. 21, but the sizes are different.

As FIG. 20 shows, the other connecting portion 30 with a bent structure comprises a fourth connecting portion 37, a fifth connecting portion 38 and a sixth connecting portion 39. One end of the fourth connecting portion 37 is connected to another straight plate section 20, another end of the fourth connecting portion 37 extends in a direction away from the other straight plate section 20, with an included angle between the fourth connecting portion 37 and the other straight plate section 20; the fifth connecting portion 38: one end of the fifth connecting portion 38 is connected to the other end of the fourth connecting portion 37, another end of the fifth connecting portion 38 extends in a direction away from the fourth connecting portion 37, with an included angle between the fourth connecting portion 37 and the fifth connecting portion 38; one end of the sixth connecting portion 39 is connected to the other end of the fifth connecting portion 38, another end of the sixth connecting portion 39 extends in a direction away from the fifth connecting portion 38, with an included angle between the fifth connecting portion 38 and the sixth connecting portion 39. The fourth connecting portion 37, fifth connecting portion 38 and sixth connecting portion 39 together form a bent structure; the length of the fourth connecting portion 37 is longer than the length of the sixth connecting portion 39, the length of the fourth connecting portion 37 is longer than the length of the first connecting portion 31, the length of the fifth connecting portion 38 is longer than the length of the second connecting portion 32, and the length of the sixth connecting portion 39 is longer than the length of the third connecting portion 33.

In the embodiments shown in FIGS. 3, 4, 7, 8, 11, 12, 15, and 16, the teachings of the present disclosure may be embodied in fuel rail assemblies. The fuel rail assembly may comprise a main fuel pipe 40, a first end cover 41 and a second end cover 42 disposed at the two ends of the main fuel pipe 40, respectively, and a self-locking internal damper as described above disposed in the main fuel pipe 40. At least one connecting portion 30 may be fixed in the first end cover 41 and/or second end cover 42.

The self-locking internal damper and the fuel rail assembly are fixed together to determine the damping effect and reliability of the self-locking internal damper. Since at least one connecting portion 30 is fixed in the first end cover 41 and/or second end cover 42 of the main fuel pipe 40 of the fuel rail assembly, positioning may be simple and the connection may be firm and reliable while also saving space, so the self-locking internal damper has a good fuel pressure stabilizing effect in the main fuel pipe 40.

In the embodiments of FIGS. 3, 4, 7, and 8, an opening of the first end cover 41 and an opening of the second end cover 42 are disposed facing each other.

In the embodiments of FIGS. 11, 12, 15, and 16, an opening of the first end cover 41 faces the interior of the chamber, while an opening of the second end cover 42 faces away from the interior of the chamber. In other words, the opening of the first end cover 41 and the opening of the second end cover 42 are not disposed facing each other. For example, in this embodiment the opening of the second end cover 42 faces way from the interior of the chamber, and the edges of the opening part are straight edges, facilitating subsequent connection by welding.

Figure 17:
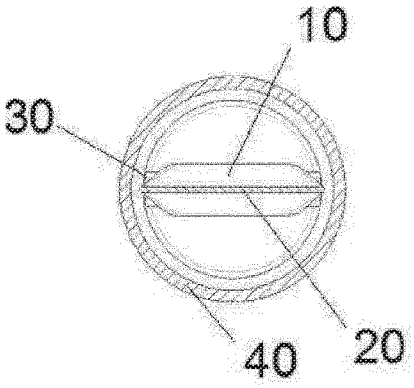
FIG. 17 shows a sectional view of a self-locking internal damper and a main fuel pipe, according to teachings of the present disclosure.

In the embodiment of FIG. 17, the cross section of the main fuel pipe 40 is round, and a center line of the chamber coincides with the axis of the main fuel pipe 40.

Figure 18:
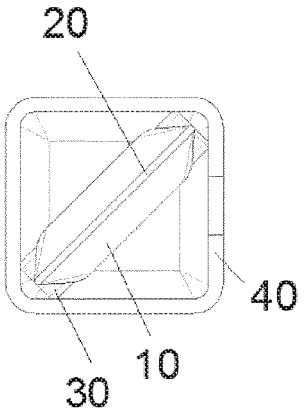
FIG. 18 shows a sectional view of a self-locking internal damper and a main fuel pipe, according to teachings of the present disclosure.

In the embodiment of FIG. 18, the cross section of the main fuel pipe 40 is square, and the plane in which the straight plate section 20 is located coincides with the plane in which a diagonal of the main fuel pipe 40 along the length direction thereof is located.

In general, the damper body 10 has a closed chamber, each of two ends of the chamber in the length direction thereof has a straight plate section 20 projecting therefrom, connecting portions 30 are further provided at the ends of the straight plate sections 20, the connecting portions 30 facilitating installation of the entire self-locking internal damper in another apparatus, and the connecting portion with a bent structure enables the self-locking internal damper to be in the fuel rail assembly more stably and firmly.

Therefore the structure is simple, processing and manufacturing are easy, product costs may be reduced, and the fuel pressure stabilizing effect may be improved. The self-locking internal damper may have a simple structure and a good fuel pressure stabilizing effect. The manner of fixing determines the damping effect and reliability of the self-locking internal damper. Since at least one connecting portion 30 is fixed in the first end cover 41 or second end cover 42 of the main fuel pipe 40 of the fuel rail assembly, positioning is simple and the connection is firm and reliable while also saving space, so the self-locking internal damper has a good fuel pressure stabilizing effect in the main fuel pipe 40.

The above embodiments are merely embodiments, and are not intended to limit the full scope of the present disclosure. From the point of view of those skilled in the art, various alterations and changes to the present utility model are possible. Any amendments, equivalent substitutions or improvements, etc. made within the spirit and principles of the present disclosure should be included in the scope of protection thereof.

What is claimed is:

1. A self-locking internal damper comprising:

a damper body with a closed chamber;

each of two ends of the closed chamber in the length direction including a straight plate section projecting therefrom, with a center line of the straight plate section passing through a center point of the closed chamber;

two connecting portions located at ends of the two straight plate sections, respectively; and at least one of the two connecting portions including a bent structure formed by extending and bending one of the straight plate sections;

wherein a size of one of the connecting portions is larger than the size of the other connecting portion.

2. The self-locking internal damper as claimed in claim 1, wherein the two straight plate sections and a center plane of the chamber in the length direction thereof are located in a shared plane.

3. The self-locking internal damper as claimed in claim 1, further comprising the two connecting portions symmetrically disposed at each of the two ends of the damper body.

4. The self-locking internal damper as claimed in claim 1, further comprising the two straight plate sections symmetrically disposed at each of the two ends of the damper body.

5. The self-locking internal damper as claimed in claim 1, wherein at least one of the straight plate sections has a rectangular shape.

6. The self-locking internal damper as claimed in claim 5, wherein one of the straight plate sections has a rectangular shape, and at least part of the other straight plate section has a trapezoidal shape, and a width of the trapezoidal straight plate section decreases progressively in a direction from the closed chamber to the connecting portion.

7. The self-locking internal damper as claimed in claim 1, wherein at least part of at least one of the straight plate sections has a trapezoidal shape.

8. The self-locking internal damper as claimed in claim 2, wherein at least one of the connecting portions with a bent structure comprises:

a first connecting portion with: a first end of the first connecting portion connected to one of the straight plate sections, a second end of the first connecting portion extending in a direction away from one of the straight plate sections, and a first included angle between the first connecting portion and one of the straight plate sections;

a second connecting portion with: a first end of the second connecting portion connected to the second end of the first connecting portion, a second end of the second connecting portion extending in a direction away from the first connecting portion, and a second included angle between the first connecting portion and the second connecting portion;

a third connecting portion with: a first end of the third connecting portion connected to the second end of the second connecting portion, a second end of the third connecting portion extending in a direction away from the second connecting portion, and a third included angle between the second connecting portion and the third connecting portion;

wherein the first connecting portion, the second connecting portion, and the third connecting portion together form the bent structure.

9. The self-locking internal damper as claimed in claim 1, wherein the two connecting portions both comprise bent structures.

10. The self-locking internal damper as claimed in claim 8, wherein the two connecting portions have the same structure.

11. The self-locking internal damper as claimed in claim 9, wherein the two bent structures are symmetrically disposed at two ends of the damper body.

12. The self-locking internal damper as claimed in claim 9, wherein the other connecting portion with the bent structure has one end connected to the other straight plate section and another end extending in a curved manner in a direction away from the other straight plate section.

13. The self-locking internal damper as claimed in claim 8, wherein the two connecting portions both comprises bent structures, and the other connecting portion with a bent structure comprises:

a fourth connecting portion, one end of the fourth connecting portion connected to the other straight plate section, another end of the fourth connecting portion extending in a direction away from the other straight plate section, with an included angle between the fourth connecting portion and the other straight plate section;

a fifth connecting portion, one end of the fifth connecting portion connected to the other end of the fourth connecting portion, another end of the fifth connecting portion extending in a direction away from the fourth connecting portion, with an included angle between the fourth connecting portion and the fifth connecting portion;

a sixth connecting portion, one end of the sixth connecting portion connected to the other end of the fifth connecting portion, another end of the sixth connecting portion extending in a direction away from the fifth connecting portion, with an included angle between the fifth connecting portion and the sixth connecting portion;

wherein the fourth connecting portion, the fifth connecting portion, and the sixth connecting portion together form the bent structure;

a length of the fourth connecting portion is longer than a length of the sixth connecting portion, the length of the fourth connecting portion is longer than a length of the first connecting portion, a length of the fifth connecting portion is longer than a length of the second connecting portion, and the length of the sixth connecting portion is longer than a length of the third connecting portion.

14. The self-locking internal damper as claimed in claim 8, wherein the connecting portion further comprises a seventh connecting portion with one end connected to the third connecting portion and another end as a free end, and the seventh connecting portion and the straight plate section are in a shared plane.

15. A fuel rail assembly comprising:

a main fuel pipe;

a first end cover and a second end cover disposed at two ends of the main fuel pipe, respectively; and a damper body with a closed chamber, the damper body disposed in the main fuel pipe;

each of two ends of the closed chamber in the length direction including a straight plate section projecting therefrom, with a center line of the straight plate section passing through a center point of the closed chamber;

two connecting portions located at ends of the two straight plate sections, respectively; and at least one of the two connecting portions including a bent structure formed by extending and bending one of the straight plate sections;

with at least one of the connecting portions fixed in the first end cover or second end cover;

wherein an opening of the first end cover faces the interior of the chamber, and an opening of the second end cover faces away from the interior of the chamber.

16. The fuel rail assembly as claimed in claim 15, wherein an opening of the first end cover and an opening of the second end cover face each other.

17. The fuel rail assembly as claimed in claim 15, wherein a cross section of the main fuel pipe is round, and a center line of the chamber coincides with a longitudinal axis of the main fuel pipe.

18. The fuel rail assembly as claimed in claim 15, wherein a cross section of the main fuel pipe is square, and a plane in which the straight plate section is located coincides with the plane in which a diagonal of the main fuel pipe along a length direction thereof is located.

* * * * *